US005310058A

United States Patent [19]

Hannen et al.

[11] Patent Number: 5,310,058

[45] Date of Patent: May 10, 1994

[54] COVER FOR ROLL OF CONVOLUTED SHEET MATERIAL

[75] Inventors: Jakob Hannen, Willich; Frank Rostek, Meerbusch, both of Fed. Rep. of Germany

[73] Assignee: Sulzer Papertec Krefeld GmbH, Krefeld, Fed. Rep. of Germany

[21] Appl. No.: 12,009

[22] Filed: Feb. 1, 1993

[30] Foreign Application Priority Data

Feb. 1, 1992 [DE] Fed. Rep. of Germany ..... 4202916

[51] Int. Cl.[5] ..... B65D 85/66

[52] U.S. Cl. ..... 206/415; 206/413; 206/396

[58] Field of Search ..... 206/413, 415, 416, 396, 206/397

[56] References Cited

U.S. PATENT DOCUMENTS

| | | | |
|---|---|---|---|
| 1,889,933 | 12/1932 | Pratt | 206/396 |
| 2,615,564 | 10/1952 | Post | 206/396 |
| 2,660,296 | 11/1953 | Dunning | 206/396 |
| 2,788,892 | 4/1957 | Dales | 206/59 |
| 3,768,641 | 10/1973 | Jerzewski, Jr. | 206/52 R |
| 3,929,226 | 12/1975 | Nijs | 206/415 X |
| 4,049,120 | 9/1977 | Bower | 206/396 |
| 4,062,447 | 12/1977 | Gardner | 206/396 |
| 4,485,612 | 12/1984 | Piesen et al. | 53/504 |
| 4,511,037 | 4/1985 | Lucous | 206/413 X |
| 4,596,108 | 6/1986 | Piesen et al. | 53/137 |

FOREIGN PATENT DOCUMENTS 3803874 6/1991 Fed. Rep. of Germany .

*Primary Examiner*—William I. Price
*Attorney, Agent, or Firm*—Darby & Darby

[57] ABSTRACT

A circular cover of corrugated cardboard for application to one end face of a roll of convoluted sheet material has two mirror symmetrical tongues which can be pivoted along parallel bending scores out of the plane of the cover for introduction into one end portion of a tubular core within a roll by an apparatus having a depository for covers and a device which transfers covers from the depository to the end faces of rolls. The depository centers and turns the covers so that each cover is properly oriented relative to the transporting device. The latter has two pivotable pushers which can pivot the tongues of a properly centered and oriented cover and thereupon insert the pivoted tongues into one end portion of a core.

33 Claims, 4 Drawing Sheets

Fig. 8
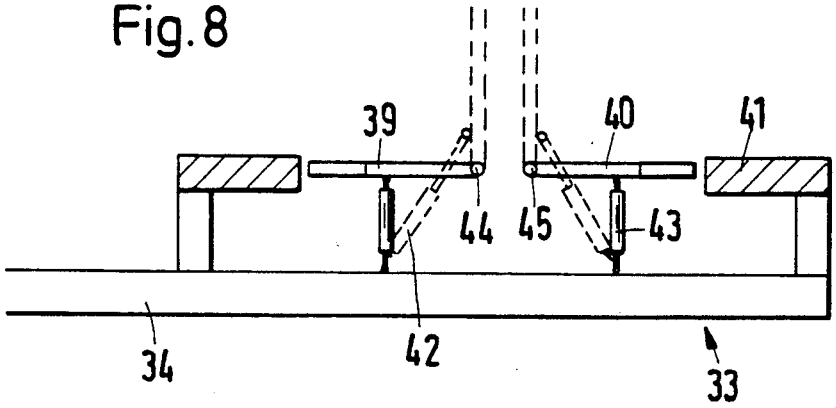
Fig. 7
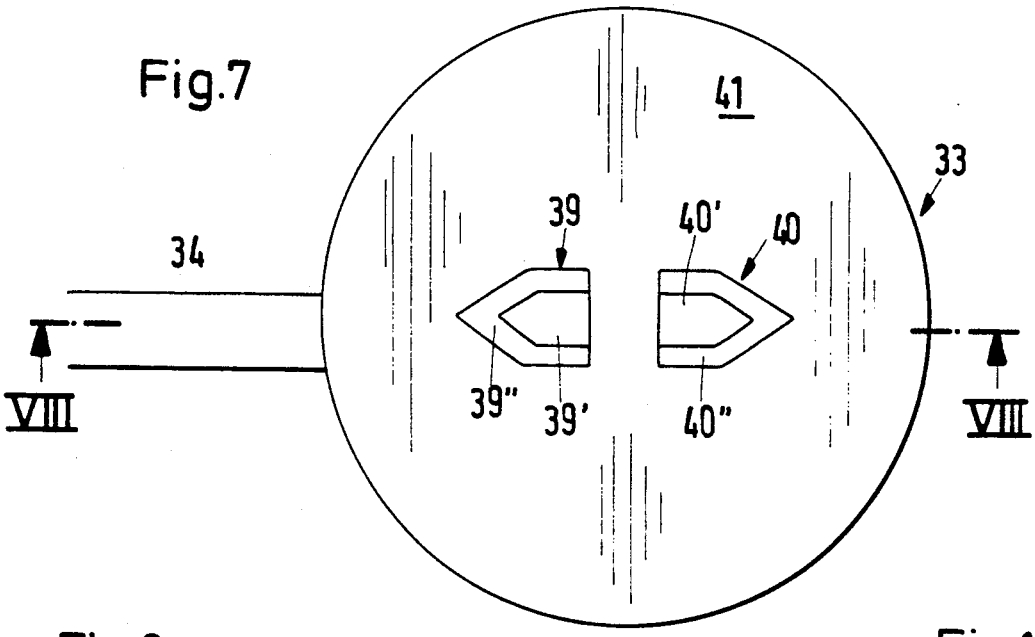
Fig. 9
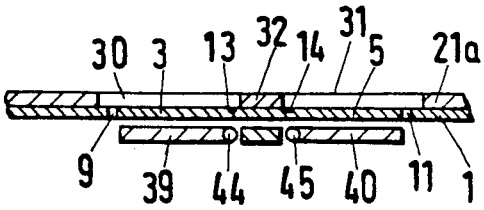
Fig. 10
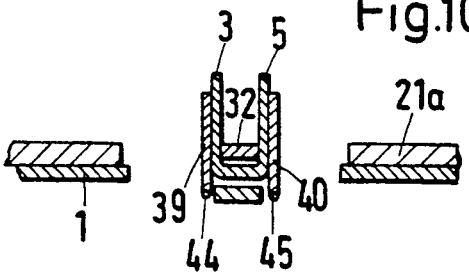
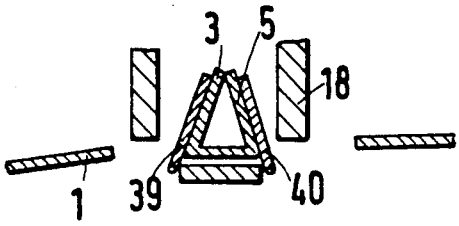
Fig. 11

COVER FOR ROLL OF CONVOLUTED SHEET MATERIAL

BACKGROUND OF THE INVENTION

The invention relates to improvements in apparatus for confining rolls of convoluted sheet material, such as paper, in envelopes. The invention also relates to portions of envelopes which can be formed in or with the improved apparatus.

It is customary to confine large rolls of convoluted paper or other sheet material in envelopes of the type designed to shield the convoluted material from damage during storage and/or transport. Reference may be had, for example, to commonly owned U.S. Pat. No. 4,485,612 granted Dec. 4, 1984 to Stefan Piesen et al. for "Apparatus for manipulating rolls of convoluted paper or the like" and to commonly owned U.S. Pat. No. 4,596,108 granted Jan. 24, 1986 to Stefan Piesen et al. for "apparatus for confining rolls of convoluted paper or the like". An envelope normally comprises (a) two disc-shaped inner covers which are placed next to the two end faces of a roll wherein a long web of paper or other sheet material is convoluted around a normally tubular core, (b) a sheet of paper or other wrapping material which is draped around the periphery of the roll and the two marginal portions (axial ends) of which are thereupon folded over the inner covers, and (c) two outer covers which are placed over the folded-over marginal portions of the applied wrapping material and are affixed (e.g., glued) to the respective marginal portions as well as to the respective inner covers.

The inner covers must be at least temporarily affixed to the roll prior to the application and folding of wrapping material so that they remain in proper positions relative to the respective end faces of the roll. The aforementioned U.S. Pat. No. 4,596,108 proposes to employ suitably configurated plugs which are driven through the inner covers and into the end portions of the core which is surrounded by the innermost convolution of sheet material. The plugs are held in requisite positions by friction or by clamping action. The inner covers can be affixed to the respective plugs by nails, clamps or in any other suitable way. Problems arise when the plugs are utilized in countries wherein the environmental protection agencies enforce strict rules against the utilization and disposal of articles, machine parts or other objects which are not made of degradable material. As a rule, or at least in many instances, the plugs are made of a material which is not readily decomposable. Moreover, the plugs cannot be reused in most instances because they are damaged or destroyed during extraction from the ends of cores of large rolls of paper or the like.

Attempts to avoid the utilization of plugs include proposals to nail, clamp or otherwise secure the inner covers directly to the rolls, particularly to the respective end portions of cores for convoluted sheet material. Such proposals have met with limited success because of potential damage to the convoluted material, for example, if a nail happens to be driven into the convoluted material in lieu of into the end portion of the core. A clamp is also likely to damage the convoluted sheet material. Furthermore, in many instances the core for a roll of convoluted paper or other sheet material is made of a metal or alloy which eliminates the possibility of using nails or clamps as a means for releasably securing inner covers to the end portions of such cores.

Additional presently known proposals to manipulate inner covers include mechanically and/or otherwise urging an inner cover against the respective end face of a roll of convoluted paper or other sheet material preparatory to or at least during draping of a sheet or wrapping material around a finished roll and during subsequent folding of the marginal portions of the convoluted wrapping material over the inner covers. The inner covers can be released when the folding of marginal portions of wrapping material is completed provided, of course, that the folded marginal portions are sufficiently stiff to hold the inner covers in requisite positions of alignment with the respective end faces of a freshly confined roll. The just discussed proposal is unsatisfactory on the ground that an inner cover which is merely pressed against the respective end face of a roll is likely to become displaced during draping of wrapping material around the roll, during folding of the marginal portions of such wrapping material over the outer sides of the inner covers and/or during subsequent manipulation of the roll and of its envelope, particularly during the application of outer covers to make the rolls ready for shipment to storage or to purchasers. In fact, an inner cover can be displaced to such an extent that it no longer contacts the respective end face of a roll which is to be provided with an enclosure or envelope or which is in the process of being confined in an envelope. Even relatively minor shifting of an inner cover from an optimum position relative to the respective end face of a roll can result in non-uniform shielding of and eventual damage to the improperly confined roll.

In many instances, the outer covers and/or the inner covers for use in envelopes which surround rolls of convoluted paper or other sheet material are made of cardboard or other relatively stiff plate-like material. U.S. Pat. No. 2,788,892 granted Apr. 16, 1957 to Nicholas G. Dales for "Tape roll support" discloses a flat square or rectangular plate-like support which is to be assembled with a roll of tape and has a projection of one piece with two relatively movable sections of the plate and provided with four parallel edges serving to frictionally engage the internal surface of a tubular core within a roll of convoluted tape. The purpose of the polygonal support is to prevent shifting of the roll of tape in a container wherein the support is held against any lateral movements.

U.S. Pat. No. 3,768,641 granted Oct. 30, 1973 to Lawrence Jerzewski, Jr. for "Adhesive tape package" discloses a box-shaped container for two rolls of adhesive tape. The rolls are located side-by-side and are held in such positions by two supports each adjacent to one of the two end faces of each roll and each having two tongues bent at right angles to the general planes of the respective supports and extending into the tubular cores of the rolls. The rolls are first assembled with the two supports, and the thus obtained assemblies of two rolls and two supports are thereupon introduced into the box-like container. The dimensions of the assemblies are such that the supports cannot move in the container, and the tongues of the supports are received in the respective cores with minimal clearance to prevent wobbling of the rolls relative to their supports.

U.S. Pat. No. 4,062,447 granted Dec. 13, 1977 to Jeffrey M. Gardner for "Reel package" discloses a retaining pad which is to prevent a roll of convoluted sheet material or tape from sliding within the confines of a box-shaped container. The pad has a square outline and is provided with two projections adapted to be pivoted out of the general plane of the pad and into the tubular core of a reel. The projections are folded over each other and are dimensioned to at least substantially fill the core.

OBJECTS OF THE INVENTION

An object of the invention is to provide a novel and improved cover for use in envelopes for rolls of convoluted sheet material.

Another object of the invention is to provide a novel and improved inner cover for use at the end face of a roll of convoluted sheet material.

A further object of the invention is to provide the cover with novel and improved means for releasably securing it to a roll of convoluted sheet material.

An additional object of the invention is to provide a simple, compact and inexpensive cover for application to the end face of a roll of convoluted paper or other sheet material.

Still another object of the invention is to provide a novel and improved method of making a cover of the above outlined character.

A further object of the invention is to provide a one-piece cover which can be mass produced in available machines.

Another object of the invention is to provide a versatile cover which can be separably affixed to different rolls of convoluted sheet material.

An additional object of the invention is to provide a novel and improved apparatus for manipulation of covers which are to be placed next to the end faces of rolls of convoluted sheet material.

Still another object of the invention is to provide an apparatus which can apply covers to the end faces of rolls having different cores.

A further object of the invention is to provide an apparatus which can orient, center, deform and/or otherwise manipulate covers prior to and during application against the end faces of rolls of paper or the like.

Another object of the invention is to provide a novel and improved method of manipulating covers on their way toward and against the end faces of paper rolls.

An additional object of the invention is to provide the above outlined apparatus with novel and improved means for temporarily storing covers prior to application against the end faces of rolls of convoluted sheet material.

Still another object of the invention is to provide the apparatus with novel and improved means for automatically orienting covers on their way from storage or from a making machine to the locus of application against the end faces of rolls of convoluted webs of paper or the like.

A further object of the invention is to provide a cover which need not be secured to a roll by a plug or by an analogous connector.

Another object of the invention is to provide a cover which need not be clamped or nailed or bolted to the core of a roll by separately produced fasteners.

An additional object of the invention is to provide a combination of a roll of convoluted sheet material and an envelope embodying covers of the above outlined character.

Still another object of the invention is to provide an envelope whose inner covers need not be nailed, clamped, plugged or otherwise secured to the core of a roll of convoluted sheet material by separately produced fastener means.

A further object of the invention is to provide the above outlined cover with novel and improved tongues or like projections for reliable but separable attachment to the core of a roll of convoluted paper or the like.

Another object of the invention is to provide a novel and improved distribution of fold lines and through cuts in a panel which is to be converted into a cover exhibiting the above outlined features and being designed for manipulation in the above outlined apparatus.

An additional object of the invention is to provide a cover which can be rapidly deformed for connection to tubular cores having different inner diameters.

Still another object of the invention is to provide an apparatus which can be installed in or utilized in combination with existing production lines for the making, wrapping and/or otherwise processing rolls of convoluted sheet material.

SUMMARY OF THE INVENTION

One feature of the present invention resides in the provision of a cover or lid for use as a part of an envelope for a roll of convoluted paper or other sheet material. The improved cover comprises a preferably stiff panel which is disposed in a predetermined plane (i.e., a generally flat panel) and includes a first section (such as a disc) and at least one second section (preferably a second section which is at least partly but most preferably fully surrounded by the first section). The panel has a through cut which is disposed between first portions of the first and second sections, a preferably straight bending score between second portions of the first and second sections, and at least one breakable web which connects the first and second sections across the through cut. The at least one second section is pivotable out of the predetermined plane along the bending score upon breakage (i.e., destruction) of the at least one web.

The panel can include a plurality of second sections, a through cut between a first portion of the first section and a first portion of each second section, and a bending score between a second portion of the first section and a second portion of each second section. Such panel can further comprise at least one breakable web extending across each through cut. The spaced-apart ends of all bending scores are preferably disposed at the periphery of a circle. For example, the panel can include two second sections and two substantially parallel bending scores; such panel further comprises a bridge which is disposed between the two bending scores and can have a width of 20–40 mm.

The cover can be used for application over an end face of a roll of convoluted sheet material wherein the roll has a substantially circular recess in its end face. The ends of the two substantially parallel bending scores are preferably located at the periphery of a circle having a diameter which matches or approximates the diameter of the substantially circular recess. The sheet material can be convoluted around a tubular core having an inner diameter which equals or approximates the diameter of the aforementioned circle.

The at least one second section or each second section of the panel can include a tip which is remote from the respective bending score and is of one piece with the respective web. The panel can have a single breakable web extending across each through cut.

Each through cut can constitute a punched or otherwise formed slot in the panel. Alternatively, each through cut can consist of a series of perforations; such panel comprises a plurality of webs, one between each pair of neighboring perforations.

The at least one second section can be provided with a second through cut which subdivides such second section into a plurality of smaller sections each of which is pivotable out of the plane of the panel along the bending score for the at least one second section. One of the smaller sections preferably surrounds another smaller section. Such panel can further comprise a second breakable web which connects the smaller sections across the at least one second through cut. The at least one second web can be weaker than the at least one web (between the first section and the at least one second section). For example, the at least one second web can be narrower than the at least one web.

The aforementioned tip of the at least one second section preferably tapers in a direction away from the respective bending score. Such at least one second section preferably further comprises a part between the tip and the breaking score, two first edge faces flanking such part of the at least one second section, and two second edge faces flanking the tip and each making an angle of 20°-60° with a different first edge face.

Each through cut can include two spaced apart portions which are adjacent and at least substantially normal to the respective bending score. Such spaced apart portions of the through cut can extend along the aforementioned first edge faces of the at least one second section. Each such portion of the through cut can have a length of at least 50 mm. The at least one second section is preferably elongated in a direction at right angles to the respective bending score. The length of the tip of such at least one second section can be between 0.8 and 2.5 times the length of the aforementioned part of the at least one second section.

The bending score can be grooved at one or both sides of the panel. The latter can contain or consist of corrugated board, mixed board or felt board. If the board of the panel includes elongated corrugations, such corrugations preferably extend substantially at right angles to the bending score for the at least one second section or any other second section.

The cover can further comprise an index or marker on the panel; such index or marker can be provided close to the circular or polygonal marginal portion of the panel. The index or marker is disposed in a predetermined orientation relative to the at least one second section and can be tracked by a suitable sensor preparatory to application of the cover to one end face of a roll of convoluted paper or the like to ensure that the pivoted second section or sections will be properly oriented relative to the aforediscussed recess or core. The index or marker can include a recess in the panel.

Another feature of the invention resides in the provision of a cover for use as a part of an envelope for a roll of convoluted paper, foil, tape or other sheet material. The cover comprises a preferably stiff panel (e.g., of cardboard or other suitable material) which is disposed in a predetermined plane (i.e., which is at least substantially flat) and includes a preferably disc-shaped first section and at least one second section which may be and preferably is at least partially (most preferably completely) surrounded by the first section. The panel has a through cut which is disposed between first portions of the first and second sections and a preferably straight bending score which is disposed between second portions of the first and second sections. The at least one second section is pivotable out of the predetermined plane along the bending score, and such at least one second section has a second through cut which subdivides it into a plurality of smaller sections each of which is pivotable out of the predetermined plane about the bending score. One of the smaller sections preferably surrounds another smaller section.

A further feature of the invention resides in the provision of an apparatus for applying covers (preferably covers of the above outlined character) to end faces of rolls of convoluted sheet material. The improved apparatus comprises a mobile cover transporting device including a support which is disposed in a predetermined plane, at least one displacing element (e.g., a pusher) serving to change the orientation of a pivotable section of a cover and being pivotably mounted on the support for movement between a first position of substantial parallelism with the plane of the support and a second position substantially at right angles to such plane, and means for pivoting the at least one displacing element between the first and second positions.

The transporting device can comprise two displacing elements and discrete means for pivoting the two displacing elements between first and second positions. The two displacing elements, and the two pivoting means, can be mirror images of each other.

The transporting device which comprises two displacing elements further comprises parallel pivot members for the displacing elements. The pivot members are provided on the support and are disposed between the two displacing elements when the displacing elements are caused to assume their first positions. These displacing elements pivot toward each other during movement from their first to their second positions.

The pivoting means can include means for moving the respective displacing elements through angles at least slightly in excess of 90° during pivoting from the first positions, i.e., each displacing element can be pivoted beyond the second position to a third position at an angle in excess of 90° relative to the first position.

The apparatus preferably further comprises a depository or temporary storage facility for covers. Such depository is provided with at least one window which serves to register with the pivotable section of a cover in the depository, and the apparatus embodying such depository further comprises means for moving the transporting device to and from a position in which the at least one displacing element can be pivoted from its first position to thereby pivot the section of the cover in the depository into the at least one window.

The depository is preferably further provided with means for turning a cover which is deposited therein. Such turning means is desirable if the covers are provided with the aforediscussed indicia or markers in predetermined orientation relative to the pivotable sections of the covers. The depository preferably further comprises means for monitoring a cover which is being turned by the turning means and for generating a signal in response to detection of an indicium. The depository further comprises means for arresting the turning means in response to the generation of a signal because the cover is then maintained in an optimum orientation for pivoting of its pivotable section and for transfer against an end face of a roll of convoluted sheet material.

The depository can further comprise means for centering a cover therein preparatory to transport of the cover to the end face of a roll of convoluted sheet material by the transporting device. The turning means can form part of or can constitute the centering means.

If the covers have pairs of pivotable sections and a bridge of predetermined width between the pivotable sections, the transporting device will comprise two displacing elements and discrete pivoting means for each displacing element. The depository then comprises two windows each of which is arranged to register with one of the two pivotable sections forming part of a properly centered and oriented cover in the depository. The latter further comprises a partition which is disposed between the two windows and has a second width which at least approximates the width of the aforementioned bridge. The partition registers with (i.e., it overlaps or is overlapped by) the bridge of a cover which is properly centered and properly oriented in the depository. The moving means is designed to move the transporting device to and from a position in which each of its displacing elements can be pivoted to thereby pivot a discrete section of the cover in the depository into the registering window.

If the improved apparatus is constructed and assembled to manipulate covers wherein a section is pivotable relative to a normally disc-shaped main section of the cover along a preferably straight bending score, the moving means is designed to move the transporting device to and from a position in which the bending score of a properly oriented and centered cover in the depository is adjacent to and is aligned with the pivot member for the at least one displacing element.

As already mentioned hereinbefore, the pivoting means of the transporting device can pivot the at least one displacing element or the respective one of two or more displacing elements from the first position, through the second position and to a third position beyond the second position at an angle in excess of 90° from the first position.

If the covers have pairs of sections which are pivotable about parallel axes, the transporting device comprises two displacing elements and means for pivoting the displacing elements from the first positions in which the displacing elements are substantially coplanar with one another, through second positions in which the displacing elements are substantially parallel to each other and are substantially normal to the plane of the cover, and to third positions at angles in excess of 90° with respect to the corresponding first positions. The depository is then designed to maintain covers in a predetermined orientation, and the means for moving the transporting device is designed to move the device to and from a position in which pivoting of the displacing elements from their first to their second positions entails pivoting of the pivotable sections through substantially 90° and subsequent pivoting of the displacing elements to their third positions results in clamping of the pivotable sections by and between the displacing elements.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

BRIEF DESCRIPTION OF THE DRAWINGS

FIG. 7 is a plan view of a cover transporting device which is employed in the apparatus of FIG. 5;

FIG. 8 is a sectional view of the transporting device substantially as seen in the direction of arrows from the line VIII—VIII in FIG. 7;

FIG. 9 is a fragmentary sectional view of a portion of the depository, of a portion of a cover in the depository and of a portion of the transporting device prior to pivoting of second sections of the cover by the displacing elements of the transporting device.

FIG. 10 illustrates the structure of FIG. 9 subsequent to pivoting of second sections of the cover through 90° from the plane of the first section of the cover; and FIG. 11 illustrates the cover of FIGS. 9 and 10, the displacing elements of the transporting device and a portion of the core of FIG. 4 during introduction of second sections into one end portion of the core.

DESCRIPTION OF PREFERRED EMBODIMENTS

Figure 1:
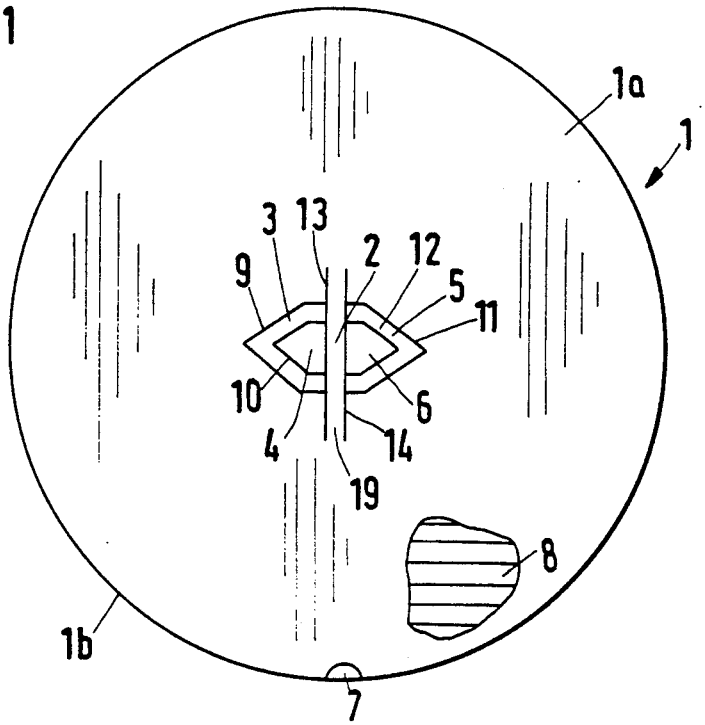
FIG. 1 is a front elevational view of a cover which embodies one form of the invention, a portion of the cover being broken away to expose certain corrugations between the two outer layers of corrugated board of which the cover is made.
Figure 2:
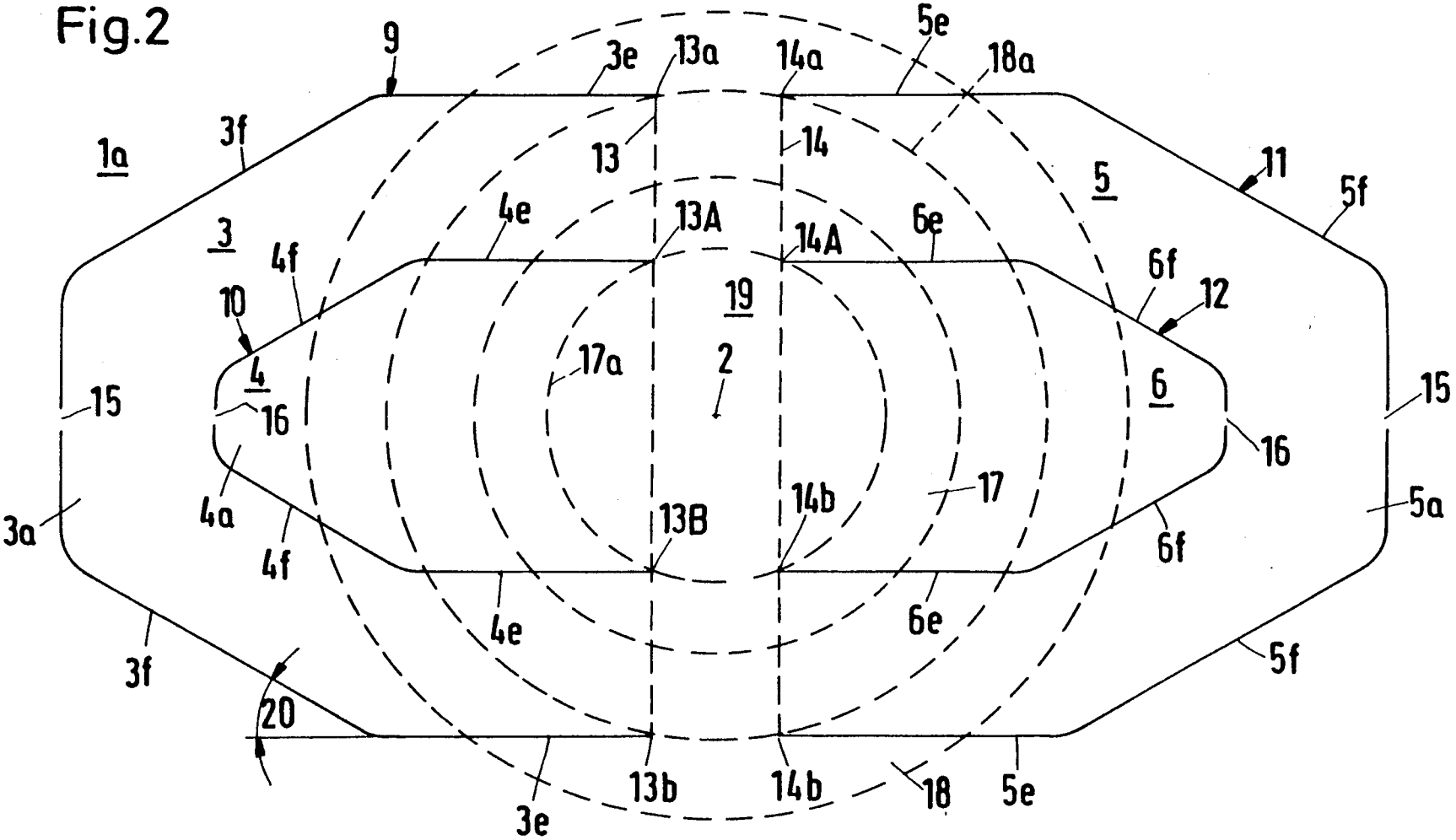
FIG. 2 is an enlarged view of the bridge and second sections of the cover which is shown in FIG. 1 two different cores being indicated by broken lines.

Referring first to FIGS. 1 and 2, there is shown a circular disc-shaped panel 1 made of relatively stiff corrugated board (certain corrugations are shown at 8) and disposed in a predetermined plane (otherwise stated, the panel 1 is flat). The major portion 1*a* constitutes a first section of the panel 1, and the latter further comprises two second sections which are mirror images of one another and are completely surrounded by the first section 1*a*. One of the two second sections includes smaller sections 3 and 4, and the other second section includes two smaller sections 5 and 6. The two second sections 3, 4 and 5, 6 are located at the center 2 of the panel 1. A first portion of the second section 3, 4 is separated from the adjacent portion of the first section 1*a* by a straight bending score or fold line 13, and a second portion of the section 3, 4 is separated from the adjacent portion of the section 1*a* by a through cut 9 in the form of a narrow slot. Analogously, first portions of the second section 5, 6 and first section 1*a* are separated from each other by a bending score or fold line 14, and the remaining second neighboring portions of the section 5, 6 and section 1*a* are separated from each other by a through cut 11 in the form of a narrow slot. The bending scores 13, 14 are parallel to each other and flank a relatively narrow bridge 19 which can be said to form part of the first section 1*a* and can have a width of between 20 and 50 mm, depending on the stiffness of the panel 1.

The marginal portion 1*b* of the first section 1*a* of the panel 1 is provided with an index or marker 7, here shown as a semicircular recess in one side of the first section 1*a*, and this marker is applied in a predetermined orientation relative to other indicia or components such as the bridge 19, the second section 3, 4 or the second section 5, 6. The illustrated marker 7 is provided in one side of the panel 1 substantially in line with an imaginary extension of the bridge 19 and substantially at an angle of 90° (as seen in the circumferential direction of the panel 1) from the tip 3*a* of the second section 3, 4 and substantially at the same angle from the tip 5*a* of the second section 5, 6. If the panel 1 of FIG. 1 is disposed in a vertical plane, the marker 7 is located at the six o'clock position, the tips 3*a*, 5*a* are located at the nine and three o'clock positions, respectively, of the marginal portion 1*b*, and the bridge 19 extends vertically in a direction from the twelve o'clock position toward the six o'clock position of the panel 1. It will be noted that the corrugations 8 of the board of which the panel 1 is made are normal to the bridge 19 and parallel to the longitudinal directions of the two tongue-like second sections 3, 4 and 5, 6; these second sections are elongated in a direction at right angles to the bending scores 13 and 14.

The second section 3, 4 can be pivoted out of the plane of the first section 1*a* through an angle of at least 90° in either of two directions, namely to the one or to the other side of the section 1*a*. FIG. 10 shows the section 3, 4 in a second position subsequent to bending or pivoting through an angle of (or close to) 90° from the first position which is shown in FIGS. 1, 2 and 9. FIG. 11 shows the section 3, 4 in a third position at an angle in excess of 90° relative to the first position of FIG. 9. The pivot axis for the second section 3, 4 is defined by the fold line or bending score 13. Analogously, the other second section 5, 6 can be pivoted (about the axis which is defined by the bending score 14) from a first position of FIGS. 1, 2 and 10, through a second position (shown in FIGS. 4 and 10 and disposed at an angle of approximately or exactly 90° relative to the first position of FIG. 9), and on to a third position (FIG. 11) at an angle in excess of 90° relative to the first position of FIG. 9.

By pivoting the second sections 3, 4 and 5, 6 from the general plane of the first section 1*a*, the apparatus to be described with reference to FIGS. 5 through 11, or the hand of a person in charge, can convert the relatively flat (and hence compact) panel 1 of FIG. 1 or 9 into a three dimensional inner cover (FIGS. 4, 10 and 11) which can be readily applied to one end face of a roll 26 (FIG. 5) of convoluted sheet material (such as paper) and which can be reliably but separably coupled to one end portion of a tubular (normally cylindrical) core 18 surrounded by the innermost convolution of sheet material.

The outer layers 8*a*, 8*b* (FIGS. 3 and 4) of the panel 1 are or can be grooved to form the fold lines or bending scores 13, 14 and to thus facilitate pivoting of the second sections 3, 4 and 5, 6 in a highly predictable manner so that each of these second sections forms a tongue which is receivable in the respective end portion of the core 18 forming part of a roll 26 of convoluted sheet material.

FIGS. 1 and 2 show that the bending scores 13 and 14 can extend beyond the sides of the respective second sections 3, 4 and 5, 6 not only in a direction toward the twelve o'clock position but also in a direction toward the six o'clock position of the panel 1. As already mentioned above, the corrugations 8 of the panel 1 (such corrugations are disposed between the outer layers 8*a* and 8*b*) extend at least substantially at right angles to the bending scores 13 and 14. It is presently preferred not to extend the bending score 13 and/or 14 all the way to the marginal portion 1*b* of the panel 1. The aforementioned orientation of the corrugations 8 relative to the bending scores 13, 14 (i.e., in the longitudinal direction of the tongues (converted second sections) 3, 4 and 5, 6) is preferred at this time because this enhances the stiffness (resistance to deformation) of the tongues and thus guarantees more reliable retention of such tongues in the core 18.

In accordance with a feature of the invention, the second section 3, 4 is a composite section including two smaller sections 3 and 4 (namely, each having an area smaller than that of the second section 3, 4), and the second section 5, 6 is also a composite section including two smaller sections 5 and 6. The sections 3 and 5 respectively surround the sections 4 and 6, the smaller sections 3 and 4 are pivotable (jointly or independently) about the axis which is defined by the bending score 13, and the smaller sections 5 and 6 are pivotable (jointly or independently) about the axis which is defined by the bending score 14. The second section 3, 4 has a through cut 10 between its smaller sections 3 and 4, and the second section 4, 5 has a through cut 12 between its smaller sections 5 and 6. The section 3 is a mirror image of the section 5, the section 4 is a mirror image of the section 6, the through cut 9 is a mirror image of the through cut 11, and the through cut 10 is a mirror image of the through cut 12 with reference to a plane which is normal to the plane of the first section 1*a* and is located midway between the bending scores 13, 14.

As can be best seen in FIG. 2, the tapered tip 3*a* of the section 3 is connected to the adjacent portion of the first section 1*a* by a relatively wide breakable web 15 of the material of the panel 1, and a similar relatively wide breakable web 15 connects the tapering tip 5*a* of the section 5 with the adjacent portion of the section 1*a*. The webs 15 extend across the respective through cuts 9 and 11, for example, in a plane which halves each of the sections 3, 4, 5, 6, which is normal to the bending scores 13, 14 and which is normal to the plane of the section 1*a*. Similar but narrower (i.e., more readily breakable) webs 16 are provided between the tips 3*a*, 4*a* of the sections 3, 4 and between the tips 5*a*, 6*a* of the sections 5, 6. The width of each web 16 (these webs extend across the respective inner through cuts 10 and 12) can be a relatively small fraction of the width of a web 15, as long as it suffices to prevent, or reduce the likelihood of, accidental pivoting of the smaller section 4 or 6 from the plane of the first section 1*a*. The relatively wide (and hence stronger) webs 15 are even less likely to be accidentally destroyed in order to permit a pivoting of the sections 3 and 5 from the plane of the first section 1*a*. Thus, it is necessary to apply a first minimal force (substantially at right angles to the plane of FIG. 2) in order to pivot the smaller section 4 or 6 from the plane of the sections 1*a*, 3, 5 upon destruction of the one or the other web 16, and it is necessary to apply a greater second minimal force to pivot the second section 3, 4 or 5, 6 from the plane of the first section 1a. If the larger force is applied to the section 3 or 5, the section 4 or 6 is compelled to share the pivotal movement of the section 3 or 5 about the respective bending score 13 or 14 even though the webs 16 are weaker than the webs 15. This is due to the fact that an intact web 16 is sufficiently strong to cause the section 4 or 6 to pivot with the respective section 3 or 5 as long as the force which is to be applied for the purpose of pivoting the section 3 or 5 is not applied only to the section 4 or 6.

Figure 3:
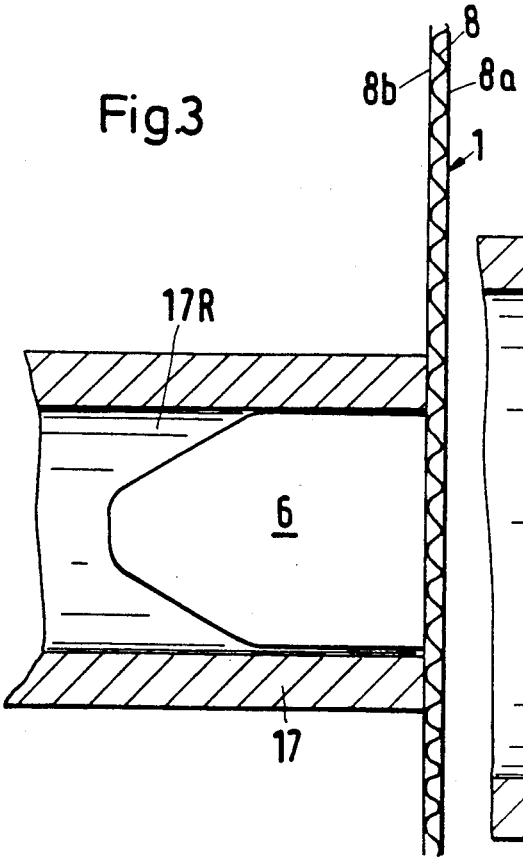
FIG. 3 is a fragmentary central sectional view of a portion of the cover of FIG. 1 subsequent to attachment to one end portion of a relatively small core which is shown in a fragmentary axial sectional view.

If only the smaller sections 4 and 6 are pivoted about the respective bending scores 13 and 14 (i.e., if the webs 16 are destroyed but the webs 15 remain intact), the two smaller sections 4, 6 constitute two tongues which extend substantially at right angles to the common plane of the sections 1a, 3 and 5 and can be frictionally received in one end portion of a smaller-diameter tubular (normally cylindrical) core 17 (see FIG. 3). Thus, by the simple expedient of selecting the magnitude and the loci of application of forces (to act against the smaller sections 3, 4 or against the smaller sections 5, 6), the person in charge of the apparatus of FIGS. 5 to 11 can (a) convert the panel 1 of FIG. 1 into an inner cover of the type shown in FIG. 3 wherein the tongues constituted by the smaller sections 4, 6 (only the smaller section 6 can be seen) couple the inner cover to an end face of a roll 26 including the core 17, or (b) into an inner cover of the type shown in FIG. 4 wherein the tongues constituted by the entire second sections 3, 4 and 5, 6 (only the section 5, 6 can be seen) couple the inner cover to an end face of a roll 26 including the core 18.

For example, the inner diameter of the core 17 which is shown in FIG. 3 can be in the range of 76 mm (three inches). The width of the tongue which is constituted by the section 6 is somewhat less than 76 mm because this tongue is not located in a plane including the axis of the core 17. The tongue which is constituted by the pivoted smaller section 6 cooperates with the other tongue (constituted by the smaller section 4) to reliably hold the inner cover (converted panel 1) of FIG. 3 in an optimum position relative to the adjacent end face of the roll 26. At such time, the tongues (converted smaller sections 4 and 6) center the inner cover on the roll 26. The reference character 17R denotes in FIG. 3 a recess which is constituted by the end portion of the axial passage in the core 17 and receives the two tongues which are constituted by the pivoted smaller sections 4 and 6 of the inner cover including the panel 1.

Figure 4:
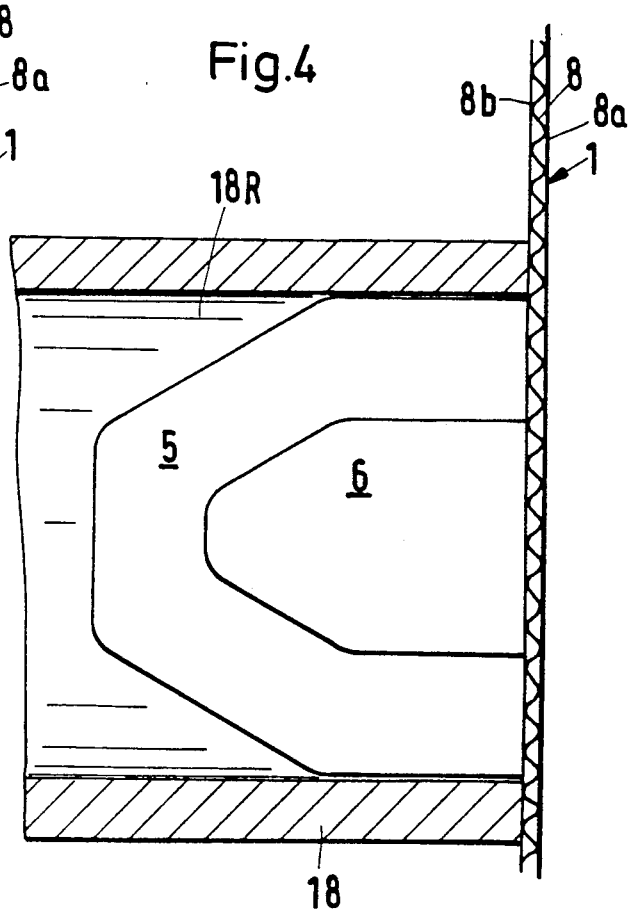
FIG. 4 is a similar fragmentary central sectional view of the cover upon application to one end portion of a larger-diameter core which is shown in a fragmentary axial sectional view.

The reference character 18R denotes in FIG. 4 a recess (namely the end portion of the axial passage in the core 18) which receives the tongues constituted by the pivoted smaller sections 3 and 5. These tongues serve to center the inner cover including the panel 1 of FIG. 4 at the respective end face of the roll 26 including the core 18. The inner diameter of the core 18 is assumed to be in the range of 150 mm (six inches) i.e., approximately twice the inner diameter of the core 17 shown in FIG. 3. FIG. 4 further shows that the web 16 between the smaller sections 5 and 6 is intact, i.e., the force which was necessary to pivot the second section 5, 6 from the plane of the first section 1a was applied only to the section 5 or simultaneously to the two sections 5, 6 so that the web 15 between the section 5 and the section 1a was destroyed but the illustrated web 16 between the smaller sections 5 and 6 remained intact. The tongues are relatively stiff and can reliably hold the inner cover in an optimum position relative to the adjacent end face of a roll 26 regardless of whether the tongues include the second sections 3, 4 and 5, 6 or only the smaller section 4 and 6. One of the reasons is that the corrugations 8 of the panel 1 extend at least substantially at right angles to the bending scores 13 and 14, i.e., in the longitudinal direction of the tongues.

It is clear that panel 1 of FIGS. 1 and 2 can be modified to provide three or more pairs of tongues. For example, each of the smaller sections 4, 6 can be provided with a through cut analogous to the through cut 10 or 12 to divide such smaller section into two still smaller sections which are connected to each other by a relatively weak breakable web corresponding to but perhaps even weaker than one of the webs 16. This renders it possible to convert the panel 1 into an inner cover which can be affixed to a core 18, to a core 17 and to a core having an inner diameter smaller than that of the core 17. Such modification or modifications would merely amount to further development of the features which are shown in FIGS. 1 to 4.

Referring again to FIG. 2, the ends 13a, 13b of the bending score 13 and the ends 14a, 14b of the bending score 14 are located at the periphery of a circle 18a having a diameter corresponding to the inner diameter of the core 18 shown in FIG. 4. Analogously, the points 13A, 13B of the bending score 13 and the points 14A, 14B of the bending score 14 are located at the periphery of a circle 17a having a diameter corresponding to that of the core 17. The cores 17 and 18 are indicated in FIG. 2 by broken line. The positioning of ends 13a, 13b, 14a, 14b at the periphery of the circle 18a ensures that the tongues constituted by the pivoted second sections 3, 4 and 5, 6 can be snugly received in the recess 18R of the core 18. The same applies for the positioning of portions ("ends") 13A, 13B and 14A, 14B of the bending scores 13, 14 at the periphery of the circle 17a. The second section 3, 4 can be pivoted along the bending score 13 between the ends 13a, 13b, the second section 5, 6 can be pivoted along the bending score 14 between the ends 14a, 14b, the smaller section 4 can be pivoted along the bending score 13 between the points 13A, 13B, and the smaller section 6 can be pivoted along the bending score 14 between the points 14A, 14B.

The width of the bridge 19 between the bending scores 13 and 14 is preferably between 20–40 mm, for example, at least close to 30 mm. The bridge 19 is narrowed if the second sections 3, 4 and 5, 6 are to frictionally engage the internal surface of the core 18 at locations close to a plane including the axis of the core 18 and/or if the smaller sections 5, 6 are to frictionally engage the internal surface of the core 7 at locations close to a plane including the axis of the core 17. On the other hand, the width of the bridge 19 should suffice to ensure that the sections 3, 4 and 5, 6 or 4 and 6 will invariably pivot along the respective bending scores 13 and 14, i.e., that the bridge 19 will offer adequate resistance to deformation in response to pivoting the second section 3, 4 between the ends 13a, 13b, in response to pivoting of the second section 5, 6 between the ends 14a, 14b, in response to pivoting of the smaller section 4 between the points 13A, 13B and/or in response to pivoting of the smaller section 6 between the points 14A, 14B.

When the second sections 3, 4 and 5, 6 extend into the core 18 in a manner as shown (for the section 5, 6) in FIG. 4, these second sections normally exhibit a certain tendency to pivot back toward the plane of the first section 1a whereby the thus generated forces cause the edge faces 3*e* and 5*e* of the sections 3, 4 and 5, 6 to bear against the internal surface of the core and thereby not only couple the inner cover to the core 18 but also center the inner cover on the end face of the roll 26. In other words, once the second sections 3, 4 and 5, 6 are pivoted to the positions shown (for the section 5, 6) in FIG. 4, the first section 1*a* of such inner cover is reliably held against any shifting in its own plane, i.e., against any movement to a position of eccentricity relative to the adjacent end portion of the core 18.

The same holds true for the centering and frictional retention of the inner cover by the core 17 of FIG. 3. The edge faces 4*e*, 6*e* of the pivoted smaller sections 4, 6 frictionally engage the internal surface of the core 17 to hold the inner cover of FIG. 3 against sidewise movements away from a position of concentricity with the adjacent end face of the core 26 as well as against unintentional extraction of the sections (tongues) 4, 6 from the recess 17R.

It is further within the purview of the invention to provide the improved panel with more than two second sections, i.e., with three or more bending scores. Such bending scores can form an equilateral, isosceles or other triangle, the four sides of a square or rectangle, and so forth. Regardless of the number of bending scores, the ends of such bending scores are preferably located at the periphery of a circle for reasons which were explained in connection with the ends 13*a*, 13*b*, 14*a*, 14*b* and points or "ends" 13A, 13B, 14A, 14B shown in FIG. 2.

The through cuts 9, 10, 11 and 12 can be formed in a stamping press or in any other suitable cutting or severing machine. Since the panel 1 is preferably made of a suitable board (such as corrugated paper board, cardboard, so-called mixed board, so-called felt board or beer felt board or a like sheet- or plate-like material), and since the cutting of panels 1 from a suitable blank can be carried out in a stamping, punching or like machine, the making of through cuts 9 to 12 can be carried out simultaneously with the formation of panels 1. Thus, the making of such through cuts does not involve any additional expenditures once a stamping or a like machine is set up for the mass-production of panels 1 or analogous panels. The making of bending scores (fold lines) 13, 14 can take place simultaneously with the making of panels 1 and of their through cuts 9 to 12. For example, the making of the fold lines or bending scores 13, 14 can involve the making of a groove into the outer side of the layer 8*a* and/or 8*b* of a corrugated board of the type shown in FIGS. 1, 3 and 4.

It is also within the purview of the invention to replace the slot-like through cuts 9 to 12 with through cuts in the form of rows of perforations. This renders it possible to dispense with the making of webs 15 and/or 16 because the perforations forming the through cuts 9 and 11 can be dimensioned and distributed in such a way that the numerous webs between such perforations cannot be destroyed as readily as the numerous webs between the perforations forming the through cuts 10 and 12. Furthermore, it is possible to make through cuts 9, 11 which consist of rows of perforations and to make through cuts 10, 12 of the type shown in FIG. 2, i.e., in the form of elongated narrow slots which are interrupted by relatively narrow and relatively weak webs 16 offering less resistance to destruction than the numerous webs between the perforations forming the through cuts 9 and 11.

FIG. 2 further shows that the tips 3*a*, 5*a* of the sections 3, 5 are respectively flanked by pairs of edge faces 3*f* and 5*f*. The edge faces 3*f* and the adjacent edge faces 3*e* make acute angles 20, preferably in the range of 20°-60°. Such configuration of the section 3 renders it possible to readily introduce its tip 3*a* into the recess 18*a* of a core 18. The angles between the edge faces 5*e* and the adjacent edge faces 5*f* of the section 5 preferably match the angles 20. The edge faces 3*e* flank a substantially rectangular part of the second section 3, 4 which is disposed between the bending score 13 and the tip 3*a* and includes two portions of the substantially U-shaped section 3 and a portion of the section 4 (between the tip 4*a* and the bending score 13). Analogously, the edge faces 5*e* of the section 5 flank a substantially rectangular part of the second section 5, 6 including two portions of the substantially U-shaped section 5 (between the bending score 14 and the tip 5*a*) and that portion of the section 6 which is disposed between the bending score 14 and the tip 6*a*. The tips 3*a*, 4*a* taper (i.e., their widths decrease) in a direction away from the bending scores 13, 14, and the tips 5*a*, 6*a* taper in the opposite direction but again away from the bending scores 13 and 14.

The tips 3*a*, 5*a* and 4*a*, 6*a* are preferably rounded at both sides of the respective webs 15 and 16 to even further simplify the introduction of the respective sections 3, 4 and 5, 6 or 4 and 6 into the recess 18R or 17R. Still further, the mutually inclined edge faces 3*f*, 5*f* of the tips 3*a*, 5*a* perform the additional function of automatically centering the inner cover of FIG. 4 relative to the core 18 and relative to the entire end face of the roll 26 embodying the core 18. Analogously, the mutually inclined edge faces 4*f*, 6*f* automatically center the tongues (pivoted sections 4, 6) in the recess 17R of the core 17 shown in FIG. 3.

Those (complementary) edge faces of the section 1*a* which are adjacent the edge faces 3*f* and 5*f* when the second sections 3, 4 and 5, 6 assume the (non-pivoted) positions of coplanarity with the first section 1*a* as shown in FIG. 1 exhibit the advantage that they can cooperate with one or more tools (not shown) which are used to at least slightly pivot the sections 3, 4 and 5, 6 toward or even beyond the positions of FIG. 10 in order to change the angular position of the panel 1 if the angular position at the time of such pivoting is not an optimum angular position of the panel 1 for application against one end face of a roll 26. All that is necessary is to configurate the pivoting tool or tools in such a way that certain surfaces of this tool or these tools cooperate with the aforementioned complementary edge faces of the section 1*a*. Thus, numerous edge faces of the second sections 3, 4 and 5, 6, of the smaller sections 3, 4, 5, 6 together constituting the second sections and/or of the first section 1*a* of a panel 1 can cooperate in a number of different ways to ensure optimal centering and optimal orientation of the panel 1 during conversion into an inner cover as well as during attachment of the inner cover to a core 17 or 18. If a roll does not have a core, the second sections 3, 4 and 5, 6 or the smaller sections 5, 6 can be received and retained directly in the axial passage within the innermost convolution of a roll of sheet material, such as paper.

The length of the edge faces 3*e* and 5*e* (these edge faces preferably extend at right angles to the bending scores 13 and 14) is preferably not less than 50 mm. Such length is selected with a view to ensure that the second sections 3, 4 and 5, 6 cannot leave the recess 18R except by drawing the inner cover of FIG. 4 in the axial direction of and away from the core 18. Analogously, if the length of the edge faces 4*e*, 6*e* is not less than 50 mm, the tongues (pivoted smaller sections 4, 6) cannot be expelled from the recess 17R (which is assumed to have a diameter in the range of 76 mm) except by pulling the inner cover of FIG. 3 axially of and away from the core 17.

The length of the tips 3*a*, 5*a* (as measured at right angles to the bending scores 13 and 14) is preferably between 0.8 and 2.5 times the length of the edge faces 3*e* and 5*e*. Though the second sections 3, 4 and/or 5, 6 can be provided with pointed tips 3*a*, 5*a*, the illustrated configurations (each of these tips resembles a trapezoidal quadrilateral with one of its sides parallel to the bending scores 13, 14) is preferred at this time.

When a panel 1 is to be separably coupled to one end face of a roll 26, e.g., by introducing its second sections 3, 4 and 5, 6 into the recess 18R of the core 18 which is shown in FIG. 4, the first step of such manipulation of the panel 1 involves pivoting of the second sections 3, 4 and 5, 6 from the plane of the first section 1*a*. This can take place prior to or during transport of the panel 1 toward and against one end face of a roll 26. It is presently preferred to pivot the second section 3, 4 simultaneously with the second section 5, 6. Introduction of tongues (pivoted second sections 3, 4 and 5, 6) into the recess 18R takes place when these tongues are disposed in planes which are at least substantially normal to the plane of the first section 1*a*. As already pointed out above, it is possible to pivot the second sections 3, 4 and 5, 6 through more than 90° (from their first positions shown in FIG. 1) to the third positions which are shown in FIG. 11; this even further simplifies the introduction of such pivoted second sections into the recess 18R.

Once the coupling step is completed, i.e., when the edge faces 3*e*, 5*e* of the sections 3, 5 are in frictional engagement with the internal surface of the core 18, the respective roll 26 is ready for draping into a suitably dimensioned piece of wrapping material (e.g., kraft paper) which is dimensioned in such a way that it can be converted into a cylinder surrounding the outermost convolution of the roll of convoluted sheet material of the roll 26 whereby the marginal portions or end portions of such cylinder extend axially beyond the outer sides of the two inner covers which are assumed to have been applied to the two end faces of the roll 26. Those (marginal or end) portions of the hollow cylinder of wrapping material which extend beyond the outer sides of the two inner covers are then folded over such outer sides so that the wrapping material holds the inner covers against movement axially and away from the respective end faces of the roll 26. The next step involves the application of outer covers, e.g., in a manner as disclosed in the aforementioned commonly owned U.S. Pats. Nos. 4,485,612 and 4,596,108 to Piesen et al. It has been found that, once the pivoted second sections 3, 4 and 5, 6 extend into and are frictionally held as well as centered in the recess 18R of the core 18, the inner cover including the panel 1, its first section 1*a* and its second sections 3, 4 and 5, 6 is reliably held in an optimum position preparatory to and during the application and folding of wrapping material. This is important because the inner covers perform a desirable function in that they cooperate with the cylindrical portion (converted sheet of wrapping material) and with the outer covers of an envelope to reduce the likelihood of damage to a roll 26 and its envelope during transport to storage, in storage and/or during shipment to a customer.

The panel 1 of FIGS. 1 and 2 can be stacked with similar panels to take up little room in storage or during transport. At such time, the pivotable sections 3 to 6 are coplanar with the first section 1*a* and the likelihood of damage to, or destruction of, the webs 15, 16 is very remote. The second sections 3, 4 and 5, 6 or the smaller sections 4 and 6 are or can be pivoted from the plane of the first section 1*a* shortly prior to introduction of pivoted sections into the recess 18R of a core 18 or into the recess 17R of a core 17. Frictional engagement between the edge faces 3*e*, 5*e* or 4*e*, 6*e* of the pivoted sections and the internal surface of the core 17 or 18 suffices to reliably hold an inner cover in an optimum position relative to a roll 26 or 26' during application of wrapping paper and during application of end portions of draped wrapping paper over the outer sides of the inner covers. Once the folded end portions of the draped wrapping material properly overlie the outer sides of the inner covers, the frictional engagement between the edge faces 3*e*, 5*e* of the pivoted sections 3 and 5 and the internal surface of the core 18 (or between the edge faces 4*e*, 6*e* of the pivoted sections 4, 6 and the internal surface of the core 17) is no longer important or is of secondary importance because the wrapping material then takes over the function of maintaining the inner covers in optimum positions relative to the respective end faces of a roll 26 or 26'. Extraction of sections 3, 4 and 5, 6 from a core 18, or extraction of sections 4, 6 from a core 17 necessitates the exertion of a relatively small force because such pivoted sections can be pivoted to their third positions (at angles of more than 90° relative to the respective first positions) to thus disengage the edge faces of the tongues from the internal surface of the respective core and allow practically unimpeded separation of an inner cover from the respective end of a roll 26 or 26' as soon as the wrapping material is removed.

An important advantage of the improved cover 1 is that it can be converted from a compact flat disc into a three dimensional inner cover in a simple and time-saving manner. Moreover, the disc-shaped panel 1 occupies little room in storage and during transport and can be converted into an inner cover which is ready to be affixed to an end face of a smaller or larger roll of convoluted sheet material. Still further, the inner cover can be affixed to a core or directly to convoluted sheet material without necessitating the utilization of aforediscussed conventional plugs, nails, clamps or other fasteners. This is particularly desirable from the point of view of ecology because all parts of an envelope for a roll of paper or the like can be made of readily decomposable material. The unpacking of a roll of paper or the like takes up a short interval of time because the inner covers are not plugged, nailed, clamped or otherwise more or less positively or permanently affixed to the core and/or to convoluted sheet material. Removal of nails, clamps, plugs or other fasteners always involves the likelihood of injury to the worker and/or the likelihood of damage to convoluted sheet material. For example, if a conventional disc-shaped inner cover is nailed to a plug which is fitted into one end of a core, and such disc-shaped inner cover is detached from the plug together with the nail or nails therein, the protruding nail or nails is or are likely to cause injury to an attendant. In spite of the absence of nails, plugs, clamps or like fasteners, the improved panel or inner cover can be reliably coupled to a core or directly to convoluted sheet material and remains in requisite position until the convoluted sheet material is ready to be put to use and, accordingly, must be unpacked from its envelope.

In its simplest form, the improved panel can be provided with a single second section 3, 4 or 5, 6, or with a single smaller section 4 or 6. The bending score 13 or 14 for such single section can extend across the center of the panel 1. However, the retaining action (e.g., in the recess 17R of the core 17 or in the recess 18R of the core 18) is much more satisfactory and reliable if the panel 1 is provided with at least two sections which are pivotable relative to the first section 1*a* along discrete bending scores. When the plural sections of a panel 1 are pivoted to their second or third positions, they constitute the sides of an open polygon. The aforediscussed positioning of the ends 13*a*, 13*b*, 14*a*, 14*b* at the periphery of a circle (the circle 18*a* in FIG. 2) is desirable and advantageous on the additional ground that such design ensures uniform distribution of the retaining forces among the pivoted sections or tongues which are to frictionally engage the internal surface of a core or the inner side of the innermost convolution of a coreless roll of convoluted sheet material.

A presently preferred embodiment of the improved panel corresponds to that which is shown in FIGS. 1 and 2. A panel with two second sections 3, 4 and 5, 6 can be converted into an inner cover which can reliably hold the first section 1*a* in an optimum position adjacent one end face of a roll 26 or 26'. At the same time, the panel 1 is not overly complex and its pivotable sections can be pivoted to their second or third positions by resorting to simple displacing elements as well as in a time-saving operation.

Since the edge faces 3*e*, 4*e*, 5*e*, 6*e* are preferably normal to the respective bending scores 13 and 14, such edge faces can be maintained in full-length frictional engagement with the internal surface of a core 18 or 17 to thus ensure the establishment of reliable and predictable frictional engagement of an inner cover with the internal surface of a core or with the internal surface of the innermost convolution of a roll of sheet material. The establishment of pronounced frictional engagement between the edge faces 3*e*, 5*e* and the internal surface of a core 18 or between the edge faces 4*e*, 6*e* and the internal surface of a core 17 is desirable on the additional ground that this greatly reduces the likelihood of lateral shifting of the first section 1*a* relative to the core 18 or 17, i.e., the inner cover remains concentric with the core and properly overlies the entire adjacent end face of a roll.

The breakable webs 15, 16 or their equivalents render it necessary to increase the force which is required to pivot the sections 3, 4 and 5, 6 or the sections 4 and 6 out of the plane of the first section 1*a*. However, the provision of such webs brings about the important advantage that the panel 1 can be more readily manipulated by automatic or semiautomatic apparatus for conversion into an inner cover which is ready to be attached to a roll 26 or 26'. In addition, these webs ensure that a panel 1 takes up a minimal amount of space during storage and/or shipment as well as that the pivotable sections are much less likely to be damaged prior to intentional conversion of the panel 1 into an inner cover of the type shown in FIG. 3 or 4. The apparatus which is selected to convert panels 1 into inner covers can be readily designed to apply the required force only to the sections 4, 6 in order to make an inner cover of the type shown in FIG. 3 or to apply the required force only to the sections 3, 5 or to the sections 3, 4 and 5, 6 in order to convert the panel into an inner cover of the type shown in FIG. 4.

The provision of webs 15, 16 at the tips 3*a*, 5*a* and 4*a*, 6*a*, respectively, also exhibits certain important advantages. Thus, the tips are remotest from the respective bending scores and, therefore, the provision of a web at the tip is most likely to reliably hold the entire section 3, 4, 5 or 6 in the plane of the first section 1*a* even if the webs are weak or extremely weak. At the same time, the application of a relatively small force to any selected portion of the section 3, 4, 5 or 6 suffices to destroy the corresponding web and permit pivoting of the respective pivotable section to its second or third position. The need for a relatively small force which is to destroy a web 15 or 16 renders it possible to simplify the construction and to reduce the energy requirements of apparatus for conversion of panels into inner covers. For example, a surprisingly small force must be applied to the tip 3*a* or 5*a* in order to destroy the respective web 15 even if such web is designed to reliably hold the section 3 or 5 in the plane of the first section 1*a*. The same holds true for the magnitude of force which must be applied to the tip 4*a* or 6*a* (i.e., at a maximum distance from the respective bending score 13, 14) to pivot the section 4 or 6 relative to the section 3 or 5 and to thus destroy the respective web 16. The application of forces to the tips 3*a*, 5*a* or to the tips 4*a*, 6*a* results in the generation of large web breaking or destroying moments due to the long lever arms, i.e., to the application of forces at considerable distances from the pivots or bending scores 13 and 14.

The provision of through cuts 9–12 in the form of slots (with interruptions at the respective webs 15 and 16) exhibits the advantage that such cuts can be made by resorting to a simple stamping, punching or like tool which also serves to cut the panel 1 out of a blank of cardboard or the like. On the other hand, the provision of through cuts in the form of the aforediscussed rows of perforations exhibits the advantage that the sections 3, 4, 5 and 6 are even more reliably held in the plane of the first section 1*a* during storage and during shipment of the panel. The dimensions of the perforations and the width of the webs between such perforations can be readily selected in such a way that the webs can be readily destroyed preparatory to pivoting of certain pivotable sections, or all pivotable sections, to their second or third positions.

The provision of second sections 3, 4 and 5, 6 which can be broken up into pairs of smaller sections contributes to versatility of the improved panel. Paper making plants often turn out rolls of convoluted sheet material which contain cores (such as 17 and 18) having different inner diameters. A panel of the type shown in FIGS. 1 and 2 is ideally suited for conversion into an inner cover which can be reliably but separably coupled to a core 17 or to a core 18. The aforediscussed inner diameters (76 mm and approximately 150 mm) are popular in many paper making and processing plants. Thus, a single series of panels 1 can be converted into inner envelopes for use with the cores 17 or 18 with minimal changes in the construction or setup of apparatus which are used to convert such panels into inner covers of the type shown in FIG. 3 or in FIG. 4. This also entails savings in storage space because a single set of panels 1 can be maintained in a state of readiness for attachment to cores 17 or 18 (or to additional types of cores if the sections 3, 5 and/or 4, 6 are also composite sections each having a through cut of the type shown at 10 and 12 in FIG. 1 or 2). Still further, the utilization of such versatile panels reduces the likelihood of improper selection of panels for the making of inner covers for two or more types of cores. Thus, the panels remain the same irrespective of the size of the recess in a core, as long as the apparatus which is used for conversion of panels 1 into inner covers is properly set up to pivot selected pivotable sections from the plane of the first section 1*a*.

The provision of relatively strong webs 15 for the tips 3*a*, 5*a* of the sections 3, 5 and of relatively weak webs 16 between the sections 3, 4 and 5, 6, respectively, constitutes a desirable and advantageous feature of the improved panel 1. Thus, the weaker webs 16 remain intact if the pivoting force is applied only to the sections 3 and 5 or is applied jointly to the sections 3, 4 and 5, 6 (to provide an inner cover of the type shown in FIG. 4), and the webs 15 remain intact if the pivoting force is applied only to the sections 4 and 6 (i.e., to form an inner section of the type shown in FIG. 3). The pivoting force which is required to convert the inner smaller sections 4, 6 into tongues of the type shown in FIG. 3 is relatively small, and a greater pivoting force is required to convert the outer smaller sections 3, 5 into portions of two tongues which respectively include the sections 3, 4 and 5, 6. In other words, the magnitude of the required pivoting forces increases in directions from the bending scores 13, 14 toward the respective stronger webs 15.

Angles 20 in the range of 20°-60° have been found to be highly satisfactory for convenient introduction of tips 3*a*, 5*a* or 4*a*, 6*a* into a recess 18R or 17R. Such angles correspond to angles between the edge faces 3*f* or 4*f* and the bending score 13 within a range of 30° and 70°. The same holds true for the range of angles between the edge faces 5*f*, 6*f* and the bending score 14 (all in the first positions of the respective pivotable sections). Such angles ensure that the camming or ramp-like action of the inclined edge faces 3*f*, 5*f* or 4*f*, 6*f* suffices to guarantee proper introduction of the respective sections 3, 4 and 5, 6 or 4, 6 into the respective recess 18R or 17R even if the plane of the first section 1*a* is not exactly normal to the axis of the core 18 or 17 during application of the inner cover to the end face of a roll 26 or 26'. At the same time, the tips are not sufficiently pointed to be likely to suffer damage during less than entirely proper introduction into a recess 17R or 18R. As shown in FIGS. 1 and 2, those portions of the tips which flank the respective webs 15 and 16 are preferably bounded by edge faces which are parallel to the respective bending scores 13 and 14; this also reduces the likelihood of damage to the tips due to less than ideal manipulation during introduction into a recess 18R or 17R.

Though it is possible to reduce the length of the edge faces 3*e*, 4*e*, 5*e*, 6*e* to less than 50 mm, relatively long edges faces 3*e*-6*e* are preferred in most instances because this ensures the establishment of a reliable frictional engagement between the pivoted second sections and the internal surface of the core 18 or between the pivoted smaller sections 4, 6 and the internal surface of the core 17. The provision of reasonably long tips 3*a*-6*a* (having a length in the range of 0.8 to 2.5 times the length of the edge faces 3*e*-6*e*) exhibits the advantage that the taper of the sloping edge faces 3*f*, 4*f*, 5*f*, 6*f* is sufficient to permit convenient introduction of pivoted sections into a recess 17R or 18R.

The length of the bending scores 13, 14 should not be less than the distance between the edge faces 3*e* or 5*e* of the respective sections 3 and 5. This ensures that the entire section 3 or 5 or the entire sections 3, 4 and 5, 6 can be readily folded for conversion into tongues. On the other hand, the scores 13 and 14 should not extend well beyond the edge faces 3*e* and 5*e* (for example, close to the marginal portion 1*b* of the panel 1) because this could result in folding of the pivotable sections as well as of the entire first section 1*a*.

Though it is also possible to make the panel 1 of a material other than paperboard or the like, the previously enumerated materials or their equivalents are preferred at this time because (a) they can be readily decomposed and (b) afford highly satisfactory protection for the end faces of rolls of convoluted paper or the like. Furthermore an inner cover which is made of cardboard or a like material can be processed for use in the making of fresh panels 1 to thus enhance the economy of the process.

The index or marker 7 need not necessarily constitute a recess in or at the marginal portion 1*b* of the panel. It is equally possible to apply a separately produced marker which is bonded or otherwise affixed to the panel 1 in a predetermined position relative to the tips 3*a*-6*a* of the sections 3-6 and/or the bridge 19. The marker 7 can be used to facilitate proper orientation of a panel 1 in a depository of the apparatus which can be employed to convert panels 1 into inner covers and to apply such inner covers to the end faces of rolls 26 or 26'. Alternatively, or in addition to such function, the marker or index 7 can also serve to facilitate proper orientation of tools (e.g., in the form of deforming or displacing elements) which are used to pivot selected pivotable sections, or all pivotable sections, relative to the first section 1*a* and/or to hold the pivoted sections during transfer of a freshly formed inner cover against one end face of a roll 26 or 26'. Markers 7 in the form of recesses are preferred at this time because they can be formed simultaneously with the making of a panel 1 and/or simultaneously with the making of bending scores 13, 14 and/or through cuts 9-12.

The application of inner covers to the end faces of rolls 26 or 26' can be carried out by hand; this also holds true for the pivoting of second sections 3, 4 and 5, 6 or smaller sections 4 and 6 from the planes of the respective first sections 1*a*. However, and especially when the inner covers are to be applied to the end faces of rolls 26 or 26' which are turned out in a large paper processing or like plant, it is preferred to carry out at least some of the steps of applying the inner covers by resorting automatic or semiautomatic apparatus. An apparatus which can be utilized to apply inner covers (different from that shown in FIGS. 1 to 4) is disclosed, for example, in published German patent application Ser. No. 38 03 874 C2 to which reference may be had, if necessary.

FIGS. 5 through 11 illustrate certain component parts of an automatic or semiautomatic apparatus which is constructed in accordance with a feature of the present invention and can be utilized to apply panels 1 or analogous panels to the end faces of rolls (such as 26 or 26') of convoluted sheet material, for example, webs of convoluted paper. The apparatus is designed to convert panels 1 into inner covers with tongues (pivoted sections) 3, 4 and 5, 6 or 4 and 6, and to apply the thus obtained inner covers to the end faces of rolls.

Figure 5:
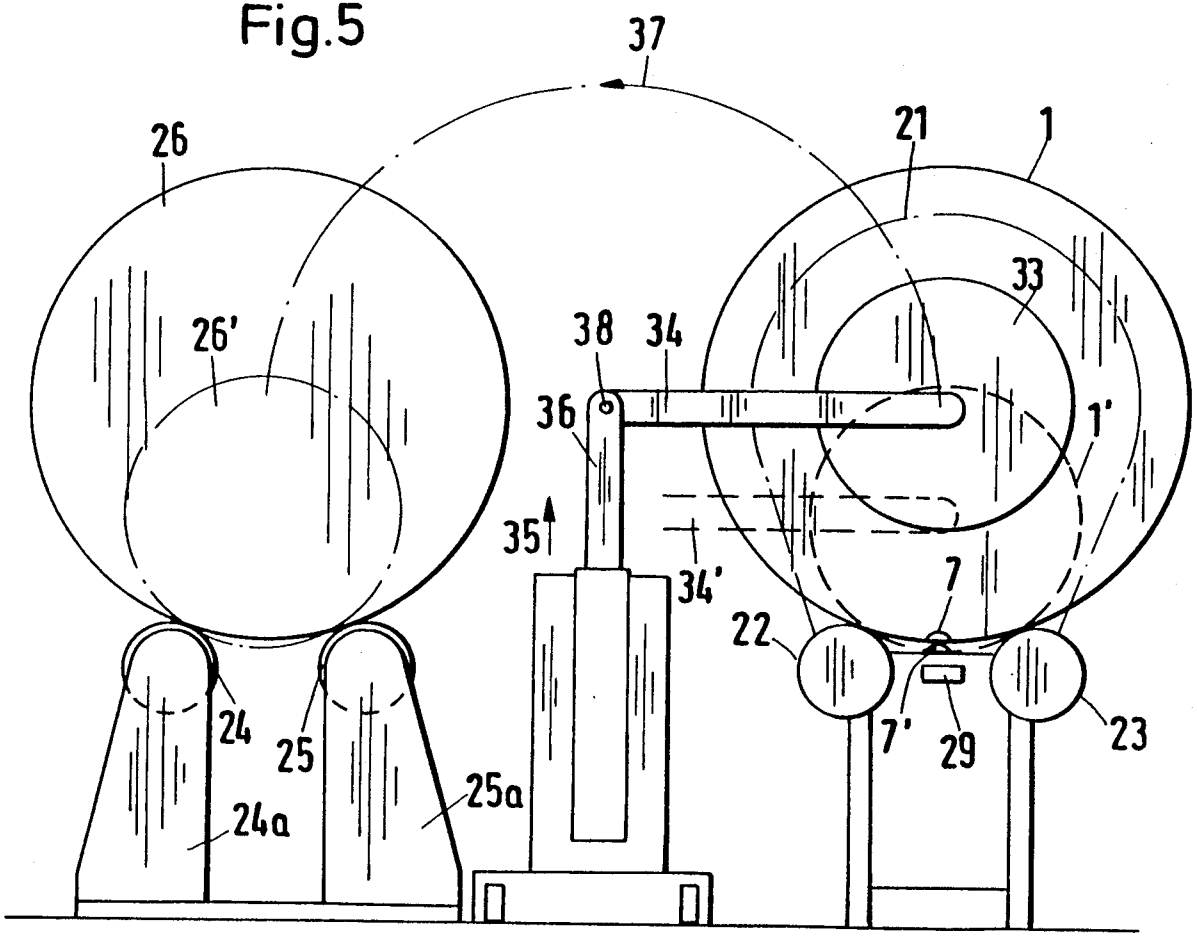
FIG. 5 is a schematic elevational view of certain components of an apparatus which is constructed and assembled in accordance with the invention and serves to transfer covers against the end faces of rolls having cores of the type shown in FIG. 3 or 4.
Figure 6:
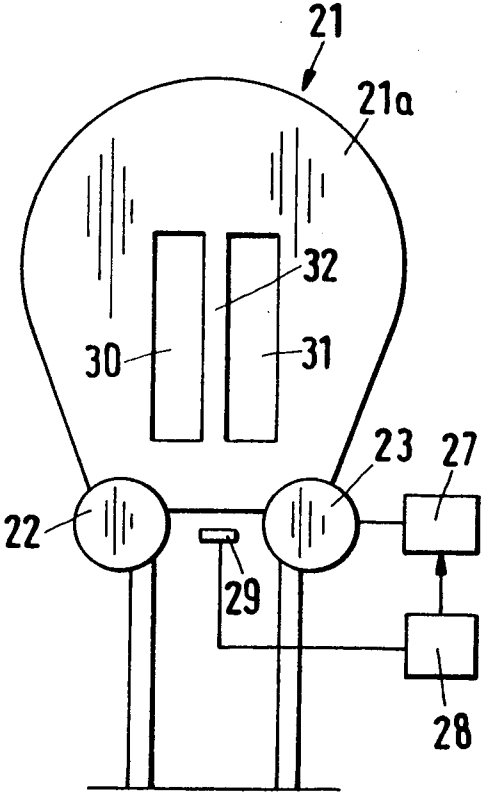
FIG. 6 is a front elevational view of a depository for covers which is utilized in the apparatus of FIG. 5.

FIG. 6 illustrates a depository 21 which forms part of the improved apparatus and receives panels 1 from storage or from another source (not shown). The depository 21 is tiltable between a substantially horizontal position (not shown), in which it receives a fresh panel 1 (not shown in FIG. 6), and the illustrated upright position in which the panel 1 therein is located in or close to a vertical plane. Tilting of the depository 21 from the horizontal position to the illustrated upright position causes the freshly delivered panel 1 to come to rest on two rotary centering members 22, 23 (hereinafter called rollers for short). The rollers 22, 23 are similar to rollers 24, 25 which are installed in suitable bearing members 24*a*, 25*b* and serve to support a roll 26 or 26' in such position that the axis of the roll resting on the rollers 24, 25 is horizontal or nearly horizontal. FIG. 5 shows the position of a horizontal larger-diameter roll 26 by a solid-line circle, and the position of a smaller-diameter roll 26' is indicated by a dot-dash line circle.

At least one (e.g., the roller 23) in the depository 21 of FIGS. 5 and 6 is driven by a motor 27 or another prime mover to change the angular position of (i.e., to turn) a panel 1 resting on the centering rollers 22, 23 until the marker 7 at the marginal portion 1*b* of such panel enters the range of a suitable optical, mechanical or other suitable monitoring device or sensor 29. The latter then transmits a signal to an arresting unit 28 for a prime mover 27 which rotates the driven roller or rollers of the depository 21. The panel 1 is arrested in an angular position in which the bridge 19 of such panel is aligned with an upright partition 32 between two windows 30, 31 in a plate-like support 21*a* of the depository. The pivotable sections 3, 4 and 5, 6 then register with the windows 30, 31, respectively, and can be pivoted by two displacing elements 39, 40 (hereinafter called pushers) of the improved apparatus to permit conversion of the panel 1 on the centering rollers 22, 23 into an inner cover of the type shown in FIG. 3 or 4, depending on the dimensions of the roll on the rollers 24, 25 and on the dimensions of the panel 1 on the centering rollers 22, 23. FIG. 5 shows by solid lines a larger-diameter panel 1 which can be converted into an inner cover for application to one end face of the larger-diameter roll 26, and (by dot-dash lines) a smaller-diameter panel 1' which can be converted into an inner cover for application to one end face of the smaller-diameter roll 26'.

The monitoring device 29, the arresting unit 28 and the prime mover 27 can be omitted if the panels 1 which are stored preparatory to transfer onto the rollers 22, 23 are invariably maintained in optimum positions to ensure that the sections 3, 4 and 5, 6 respectively register with the windows 30, 31 when the introduction of a panel 1 into the depository 21 is completed. Such simplified depository 21 need not employ centering rollers 22, 23; for example, such rollers can be replaced with a simple horizontal strip or plate to serve as a rest for a panel 1 while the bridge 19 of the panel registers with the partition 32 between the windows 30, 31 in the plate-like support 21*a* of the simplified depository.

The width of the partition 32 may but need not exactly match the width of a bridge 19.

The apparatus of FIGS. 5 and 6 further comprises a mobile cover transporting device 33 the details of which are shown in FIGS. 7 to 11 and which serves to transfer successive (properly oriented) inner covers (i.e., converted panels 1) from the rollers 22, 23 of the depository onto the rollers 24, 25 for a roll 26 so that the tongues 3, 4 and 5, 6 or 4 and 6 of an inner cover can enter the recess 18R of a core 18 or the recess 17R of a core 17, depending upon whether the roll 18 contains sheet material which is convoluted around a core 18 or 17. An arm 34 which is pivotable about the axis of a horizontal pivot member 38 is provided to move the transporting device 33 along an arcuate path (note the arrow 37 in FIG. 5) between a first position of alignment with a panel 1 on the rollers 22, 23 of the depository 21 (while the depository is maintained in the upright position shown in FIGS. 5 and 6) and a second position of alignment with a roll 26 on the rollers 24, 25. The pivot member 38 and the arm 34 are movable up and down (in and counter to the direction of arrow 35 shown in FIG. 5) by a suitable motor (e.g., a fluid-operated cylinder and piston unit having a motion transmitting member 36 carrying the pivot member 38. This renders it possible to move the arm 34 between a first position which is shown in FIG. 5 by solid lines (in which the device 33 can transfer larger-diameter panels 1) and a second position 34' (which is indicated by broken lines and in which the device 33 is ready to transfer smaller-diameter panels 1' to positions of register with rolls 26'. Of course, the unit including the member 36 will be designed to move the pivot member 38 three or more levels if the apparatus of FIG. 5 is designed to transfer three or more types of panels (i.e., panels having different first, second, third, etc. diameters) from the depository 21 to a roll on the rollers 24, 25.

The character 7' denotes in FIG. 5 the index or marker of a smaller-diameter panel 1'. Such marker can be monitored by the device 29 in the same way as described above for the marker 7 of a panel 1 on the rollers 22, 23 of the depository 21.

In the apparatus which is shown in FIG. 5, the level of the pivot member 38 is proper if it coincides with the level of the axis of a roll 26 (i.e., with the axis of a core 17 or 18 forming part of such roll if the roll 26 embodies a core) on the rollers 24, 25. This means that the arm 34 must pivot the device 33 along an arc 37 of 180° in order to move a properly oriented inner cover (converted panel 1) to a position of accurate register with one end face of a roll 26 on the rollers 24, 25. The pivot member 38 will be lowered to the level of the axis of a roll 26' on the rollers 24, 25 if the device 33 is to transfer an inner cover constituting a converted smaller-diameter panel 1' or a series of successive inner covers constituting converted panels 1'.

The transporting device 33 comprises a support 41 whose plane coincides with that of the two pivotable displacing elements or pushers 39, 40 when the pushers are maintained in the first or retracted positions which are shown in FIGS. 7, 8 and 9. The means for pivoting the pushers 39, 40 relative to the support 41 comprises two fluid-operated motors 42, 43 which are mounted on the support 41 (actually on the arm 34 which, however, is shown as being rigid with the support 41). The motors 42, 43 can respectively pivot the pushers 39, 40 from the first positions of FIGS. 7, 8 and 9 to second positions shown in FIG. 10 (and also indicated in FIG. 8 by broken lines) and beyond the second positions to third positions which are shown in FIG. 11. The pushers 39 and 40 must be pivoted in opposite directions through angles in excess of 90° in order to move from the first positions (FIG. 9) to the third positions of FIG. 11.

The pusher 39 includes two portions 39', 39'' which are articulately connected to each other by a pivot member 44 on the support 41. Analogously, the pusher 40 includes two portions 40', 40'' which are articulately connected to each other by a pivot member 45 on the support 41. As can be seen in FIG. 7, the portions 39', 40', 39'', 40'' respectively resemble the sections 3, 5, 4, 6 of a panel 1. When the portions 39', 39'' of the pusher 39 are affixed to each other so that they cannot pivot independently of one another about the axis which is defined by the pivot member 44, they can jointly pivot the smaller sections 3, 4 of a second section 3, 4. Analogously, when the portions 40', 40'' of the pusher 40 are affixed to each other to pivot as a unit about the axis which is defined by the pivot member 45, they can pivot the smaller sections of a second section 5, 6 as a unit relative to the corresponding first section 1*a*. If the portions 39', 40'can pivot independently of the portions 39'', 40'', they can pivot the smaller sections 4 and 6 relative to the sections 3, 5 and 1*a*. The exact manner of separably coupling the portions 39', 39'' of the pusher 39 and for separably coupling the portions 40', 40'' of the pusher 40 to each other forms no part of the present invention. Such connections can be established by pins, studs, bolts, screws or in any other suitable way.

It is further within the purview of the invention to provide four discrete motors, one for each of the four portions 39', 39'', 40', 40'' and to provide means for operating the motors for the portions 39', 39'' in synchronism or independently of each other. The same holds true for the discrete motors which can be provided for the portions 40', 40'' of the pusher 40. The provision of four motors renders it unnecessary to employ means for separably coupling the portions 39', 39'' and 40', 40'' to each other.

The mode of operation of the apparatus which embodies the structure of FIGS. 5 to 11 is as follows:

It is assumed that a panel 1 rests on the rollers 22, 23 of the depository 21 and that the support 21*a* of the depository is maintained in or close to the upright position as shown in FIGS. 5 and 6. The rollers 24, 25 support a roll 26 and the pivot member 38 is held at the level of FIG. 5, i.e., its axis is parallel with and is located at or close to the level of the axis of the roll 26. The latter is assumed to contain a core 18 of the type shown in FIG. 4. The orientation of the panel 1 on the centering rollers 22, 23 is such that the sections 3, 4 and 5, 6 of such panel respectively register with the windows 30 and 31 in the support 21*a* of the depository 21.

The pushers 39, 40 on the support 41 of the transporting device 33 are aligned with the windows 30, 31 in such a way that the pivot members 44, 45 for such pushers are in register with the bending scores 13, 14 of the panel 1 on the rollers 22, 23. The motors 42, 43 are thereupon actuated to pivot the pushers 39, 40 through angles of 90° or a little less than 90° (from the positions of FIG. 9 to the positions of FIG. 10) whereby the pushers 39, 40 respectively pivot the second sections 3, 4 and 5, 6 into two planes which are substantially normal to the plane of the first section 1*a* (this, too, can be seen in FIG. 10). Even though the second sections 3, 4 and 5, 6 are pivotable along grooved or similarly weakened bending scores 13 and 14, they exhibit a certain tendency to reassume the positions of FIG. 9 (of coplanarity with the first section 1*a*) so that they bear against the adjacent sides of the respective pushers 39, 40. FIG. 10 further shows that the second sections 3, 4 and 5, 6 were pivoted into and through the respective windows 30, 31 in the support 21*a* of the depository 21. The pivoted second sections 3, 4 and 5, 6 are in rather pronounced frictional engagement with the adjacent sides of the pushers 39, 40. The pushers 39, 40 are thereupon moved downwardly, as viewed in FIG. 10, (toward the observer of FIG. 5) so that the pivoted second sections 3, 4 and 5, 6 are located at one side of the support 21*a* and are ready to be pivoted with the arm 34 in the direction of arrow 37 to move the thus obtained inner cover (converted panel 1) to a position of alignment with one end face of the roll 26 on the rollers 24, 25. Since the second sections 3, 4 and 5, 6 tend to bear against the adjacent sides of the pivoted pushers 39, 40, they can readily bypass the partition 32 on their way out of the respective windows 30, 31.

In order to reduce the likelihood of any stray movements of an inner cover relative to the transporting device 33 subsequent to extraction of the second sections 3, 4 and 5, 6 from the respective windows 30 and 31, the pushers 39, 40 can be pivoted to the third positions of FIG. 11 before the arm 34 begins to move the device 33 in the direction of arrow 37. This can be achieved by the simple expedient of employing motors 42, 43 of the type capable of moving their piston rods between three different axial positions including those shown in FIGS. 9, 10 and 11. Other types of motors can be utilized with equal or similar advantage.

When the inner cover which is carried by the device 33 reaches a position of alignment with one end face of the roll 26 on the rollers 24, 25, the arm 34 is caused (e.g., by moving the entire motor including the member 36) to advance in the axial direction of and toward the adjacent end face of the roll 26 so that the pushers 39, 40 introduce the second sections 3, 4 and 5, 6, (in the positions shown in FIG. 11) into the recess 18R of the core 18 in the roll 26. The next step involves pivoting of the pushers 39, 40 from the third positions of FIG. 11 toward and preferably even beyond the second positions of FIG. 10 (i.e., further toward the positions of FIG. 9) so that the edge faces 3*e*, 5*e* of the sections 3, 5 can engage the internal surface of the core 18 and thus couple the inner cover to the roll 26 in an optimum position of alignment with the adjacent end face of such roll. The device 33 is then withdrawn in the axial direction of the roll 26 so that the pushers 39, 40 are extracted from the recess 18R and the arm 34 can pivot the device 33 back to the position of FIG. 5.

If desired, the retaining action of the pushers 39, 40 (to hold an inner cover in the position shown in FIG. 10 ready to transfer into alignment with an end face of a roll 26) can be assisted by suction, e.g., by providing the pushers 39, 40 with suction ports which are connected to a suction generating device not later than when the pushers 39, 40 are pivoted from the positions of FIG. 9 to the positions of FIG. 10. Such assistance by suction generating means is not necessary or not always necessary because the frictional engagement between the pivoted sections 3, 4 and 5, 6 on the one hand and the adjacent sides of the pushers 39, 40 on the other hand normally suffices to ensure predictable transport of inner covers (converted panels 1) from the centering rollers 22, 23 of the depository 21 to optimum positions adjacent the end faces of rolls 26 on the roller 24, 25. The absence of suction-operated means for temporarily attracting inner covers to the device 33 contributes to simplicity and lower cost of the improved apparatus.

The apparatus of FIGS. 5 to 11 will be modified in the aforediscussed manner if the device 33 is to transport converted panels 1' from the depository 21 into register with end faces of smaller-diameter rolls 26'. This necessitates a lowering of the pivot member 38 with the arm 34 and device 33, separation of portions 39', 40' from the portions 39'', 40'' of the respective pushers 39, 40 and pivoting of the separated portions 39', 40' relative to the adjacent portions 39'' and 40'', respectively. In all other respects, the apparatus will be operated in the same way as described above in connection with the application of inner covers which constitute converted panels 1.

The improved apparatus renders it possible to properly apply converted panels 1 or 1' to rolls 26 and 26' without resorting to plugs, nails, clamps or other prior art devices which contribute to the cost and complexity of the apparatus and are more likely to cause injury to attendants and/or damage to the rolls of paper or other convoluted sheet material. As a rule, nails or clamps are propelled into the core of a roll 26 or 26', or into a plug in the core, by a suitable gun. The manipulation of such gun involves additional work and the supply of nails or clamps in the magazine for such gun must be replenished at frequent intervals. All this can be dispensed with by resorting to the improved panels 1 or 1' and to the improved apparatus which can apply the panels without guns or the like.

The apparatus of FIGS. 5 to 11 can be modified in a number of additional ways without departing from the spirit of the invention. For example, the substantially plate-like pushers 39, 40 can be replaced by or provided with suitably bent levers which are connected to the output elements of the respective motors 42, 43 or with other suitable means for pivoting the pushers.

The aforedescribed mounting of pivot members 44, 45 on the support 41 of the device 33 (so that the pivot members are located between the pushers 39, 40 in the first positions of these pushers) is desirable and advantageous because this ensures that a panel 1 which abuts the support 21*a* of the depository 21 is not acted upon by forces tending to move the second sections 3, 4 and 5, 6 out of alignment with the windows 30 and 31. The tendency of one of the pushers 39, 40 to shift a panel 1 in the depository 21 sideways is counteracted by the other pusher so that the resultant force acts only in a direction at right angles to the plane of the support 21*a*, namely to pivot the sections 3, 4 and 5, 6 about the respective bending scores 13 and 14.

The extent of pivotability of the pushers 39, 40 from the second positions of FIG. 10 to the third positions of FIG. 11 can be a small fraction of the angle (90°) between the first and second positions of such pushers. All that is necessary is to ensure that, when they assume the angular positions of FIG. 11, the pushers 39, 40 can reliably hold and transport an inner cover (converted panel 1) from the depository 21 onto the rollers 24, 25 adjacent an end face of a roll 26 even if they are not provided with suction ports, suction cups or other means for pneumatically attracting inner covers during transfer from the rollers 22, 23 onto the rollers 24, 25.

The depository 21 resembles the depository which is disclosed in the published German patent application Ser. No. 38 03 874 C2 except that the depository of the German reference does not exhibit any windows. In other words, the depository which is disclosed in the German reference serves primarily or exclusively to center a panel on its way from storage toward a position of alignment with one end face of a roll of convoluted paper or other sheet material. In the depository 21 of the improved apparatus which is shown in FIGS. 5 to 11, the support 21*a* not only maintains a panel 1 in an optimum position for engagement by the pushers 39, 40 of the transporting device 33 but it also cooperates with such pushers to ensure that the panel 1 is converted into an inner cover before it reaches the rollers 24, 25. The depository 21 of the improved apparatus exhibits the additional advantage that it can accept panels 1 rather than inner covers so that the space requirements of such depository are minimal. Turning of a panel 1 on the rollers 22, 23 ensures that the panel 1 is moved to an angular position in which its second sections 3, 4 and 5, 6 are in accurate alignment with the respective windows 30, 31 before the motors 42, 43 are caused to pivot the pushers 39, 40 for the purpose of pivoting the sections 3, 4 and 5, 6 to the positions which are shown in FIG. 10.

The width of the partition 32 between the windows 30, 31 of the support 21*a* can be slightly less than but should not exceed the width of the bridge 19 in a panel 1. This ensures that, once a panel 1 is properly centered and oriented by the depository 21, its sections 3, 4 and 5, 6 can be pivoted along the respective bending scores 3, 4 to assume the positions of FIG. 10 and thereupon, if necessary the positions of FIG. 11. The partition 32 prevents undue deformation of a bridge 19 during pivoting of the sections 3, 4 and 5, 6 from the plane of the first section 1*a* of a panel 1 on the rollers 22, 23. The feature that the axes of the pivot members 44, 45 are parallel with and closely adjacent to the bending scores 13, 14 when the pushers 39, 40 are ready to move from the positions of FIG. 9 to the positions of FIG. 10 ensures that friction between the pivoting pushers 39, 40 and the adjacent sections 3, 4 and 5, 6 (during pivoting of the pushers from the positions of FIG. 9 to the positions of FIG. 10) is minimal. This reduces the energy requirements of the motors 42, 43 and reduces the likelihood of damage to the second sections 3, 4 and 5, 6 during pivoting to positions at right angles to the plane of the first section 1*a* of a panel 1 on the rollers 22, 23.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A cover for use as a part of an envelope for a roll of convoluted sheet material, comprising a stiff panel disposed in a predetermined plane and including a first section and at least one second section, said panel having a through cut disposed between first portions of said sections, a bending score between second portions of said sections, and at least one breakable web connecting said sections across said through cut, said at least one second section being pivotable out of said plane along said bending score upon breakage of said at least one web.

2. The cover of claim 1, wherein said panel includes a plurality of second sections, a through cut between a first portion of said first section and a first portion of each second section, and a bending score between a second portion of said first section and each second section.

3. The cover of claim 2, wherein said panel comprises at least one breakable web extending across each of said through cuts.

4. The cover of claim 2, wherein each of said bending scores has spaced apart first and second ends, all of said ends being disposed at the periphery of a circle.

5. The cover of claim 2, wherein said panel includes two second sections and two substantially parallel bending scores.

6. The cover of claim 5, wherein said panel comprises a bridge disposed between said bending scores and having a width of 20–40 mm.

7. The cover of claim 2, for application over an end face of a roll of convoluted sheet material wherein the roll has a substantially circular recess in the end face thereof and the recess has a predetermined diameter, wherein each of said bending scores has spaced apart first and second ends, said ends being disposed at the periphery of a circle having a second diameter at least approximating said predetermined diameter.

8. The cover of claim 2, for application over an end face of a roll of sheet material which is convoluted around a tubular core having a predetermined inner diameter, wherein each of said bending scores has spaced apart first and second ends and said ends are disposed at the periphery of a circle having a second diameter at least approximating said predetermined diameter.

9. The cover of claim 1, wherein said at least one second section has a tip remote from said bending score and of one piece with said at least one web.

10. The cover of claim 1, wherein said panel has a single breakable web extending across said through cut.

11. The cover of claim 1, wherein said through cut is a punched slot in said panel.

12. The cover of claim 1, wherein said through cut consists of a series of perforations.

13. The cover of claim 1, wherein said at least one second section has at least one second through cut subdividing said at least one second section into a plurality of smaller sections each of which is pivotable out of said plane along said bending score.

14. The cover of claim 13, wherein one of said smaller sections surrounds another of said smaller sections.

15. The cover of claim 13, wherein said panel further includes at least one second breakable web connecting said smaller sections across said at least one second through cut.

16. The cover of claim 15, wherein said at least one second web is weaker than said at least one web.

17. The cover of claim 16, wherein said at least one second web is narrower than said at least one web.

18. The cover of claim 1, wherein said at least one second section has a tapered tip remote from said bending score.

19. The cover of claim 18, wherein said at least one second section further includes a part between said tip and said breaking score, said at least one second section having two first edge faces flanking said part thereof and two second edge faces flanking said tip and each making an angle of 20°–60° with a different one of said first edge faces.

20. The cover of claim 1, wherein said through cut includes two spaced apart portions adjacent and at least substantially normal to said bending score.

21. The cover of claim 20, wherein each of said portions of said through cut has a length of at least 50 mm.

22. The cover of claim 20, wherein said at least one second section is elongated in a direction at right angles to said bending score and includes a tapering tip remote from said bending score and a part flanked by said portions of said through cut and disposed between said bending score and said tip, said part of said at least one second section having a first length and said tip having a second length between 0.8 and 2.5 times said first length.

23. The cover of claim 1, wherein said bending score is grooved.

24. The cover of claim 1, wherein said panel contains corrugated board.

25. The cover of claim 1, wherein said panel contains mixed board.

26. The cover of claim 1, wherein said panel contains felt board.

27. The cover of claim 1, wherein said panel contains board having elongated corrugations extending substantially at right angles to said bending score.

28. The cover of claim 1, further comprising an index on said panel.

29. The cover of claim 28, wherein said panel has a marginal portion and said index is adjacent said marginal portion.

30. The cover of claim 28, wherein said index is disposed in a predetermined orientation relative to said at least one second section.

31. The cover of claim 28, wherein said index includes a recess in said panel.

32. A cover for use as a part of an envelope for a roll of convoluted sheet material, comprising a stiff panel disposed in a predetermined plane and including a first section and at least one second section, said panel having a through cut disposed between first portions of said sections and a bending score between second portions of said sections, said at least one second section being pivotable out of said plane along said bending score and said at least one second section having a second through cut subdividing said at least one second section into a plurality of smaller sections each of which is pivotable out of said plane about said bending score.

33. The cover of claim 32, wherein one of said smaller sections surrounds another of said smaller sections.

* * * * *